United States Patent [19]

Bryant

[11] Patent Number: 4,565,167

[45] Date of Patent: Jan. 21, 1986

[54] INTERNAL COMBUSTION ENGINE

[76] Inventor: Clyde C. Bryant, 1920 Forrest Ave., East Point, Ga. 30344

[21] Appl. No.: 612,660

[22] Filed: May 21, 1984

Related U.S. Application Data

[63] Continuation-in-part of Ser. No. 327,922, Dec. 8, 1981, abandoned, which is a continuation-in-part of Ser. No. 230,752, Feb. 2, 1981, abandoned.

[51] Int. Cl.[4] ..... F02B 33/22

[52] U.S. Cl. ..... 123/70 R; 123/560; 417/364

[58] Field of Search ..... 123/70 R, 70 V, 560; 417/237, 380, 364

[56] References Cited

U.S. PATENT DOCUMENTS

| | | | |
|---|---|---|---|
| 1,389,337 | 8/1921 | Wolfard | 123/70 V |
| 2,102,946 | 12/1937 | Dugelay | 123/560 |
| 2,281,821 | 5/1942 | Balmer | 123/70 R X |
| 2,500,366 | 3/1950 | Lamberton | 417/364 |
| 2,594,845 | 4/1952 | Baumann | 123/70 R |
| 2,736,488 | 2/1956 | Dros | 417/364 |
| 3,623,463 | 11/1971 | De Vries | 123/70 R |
| 3,675,630 | 7/1972 | Stratton | 123/70 R |
| 3,880,126 | 4/1975 | Thurston et al. | 123/70 R |
| 4,351,278 | 9/1982 | Gaschler et al. | 417/364 X |

*Primary Examiner*—Parshotam S. Lall
*Assistant Examiner*—W. R. Wolfe

[57] ABSTRACT

The invention is concerned with a method of deriving mechanical work from a combustion gas in an internal combustion engine and reciprocating internal combustion engines for carrying out the method. The method includes the steps of compressing an air charge in a compressor of the engine, transferring the compressed charge to a power chamber of the engine such that no appreciable drop in charge pressure occurs during transfer and admission to the power chamber, causing a predetermined quantity to produce a combustible mixture, causing the mixture to be ignited at substantially maximum pressure within the power chamber and allowing the combustion gas to expand against a piston operable in the power chamber substantially beyond its initial volume.

20 Claims, 14 Drawing Figures

INTERNAL COMBUSTION ENGINE

This application is a continuation-in-part of U.S. application Ser. No. 327,922 filed Dec. 8, 1981, now abandoned which is a continuation-in-part of U.S. application Ser. No. 230,752 filed Feb. 2, 1981, now abandoned.

This invention relates to a method of deriving mechanical work from combustion gas in an internal combustion engine by means of a new thermodynamic working cycle and to reciprocating internal combustion engines for carrying out the method.

BACKGROUND OF INVENTION

It is well known that as the expansion ratio of an internal combustion engine is increased, more energy is extracted from the combustion gases and the thermodynamic efficiency increases. It is further understood that increasing compression increases both power and fuel economy due to further thermodynamic improvements. The objectives for an efficient engine are to provide high compression, begin combustion at maximum compression and then expand the gases as far as possible against a piston.

Conventional engines have the same compression and expansion ratios, the former being limited by the octane rating of the fuel. Furthermore, since in these engines the exploded gases can only be expanded to their initial volume, there is usually a pressure of 70–100 psi against the piston at the time the exhaust valve opens with the resultant loss of energy.

Many attempts have been made to extend the expansion process in internal combustion engines to increase their thermodynamic efficiency. An early design was described in the Brayton cycle engine of 1872 (U.S. Pat. No. 125,166). This engine expanded the combustion gases to their initial pressure but lacked the means of transferring and igniting the charge while maintaining maximum compression. The Atkinson cycle engine was devised to extend the expansion process, but this engine was limited by its mechanical complexity to a one-cylinder configuration.

A notable attempt was more recently revealed in the Wishart engine, disclosed in U.S. Pat. No. 3,408,811, in which a large piston compressed the charge into a smaller cylinder which further compressed the charge and then transferred it into another small "firing" cylinder where the charge was ignited and expanded to the full volume of the smaller cylinder. It then passed the burned gases through ports uncovered by the piston into a larger cylinder where it was expanded further. This required four cylinders with pistons which made two working strokes for each power stroke, hence it is an eight-stroke cycle engine with all of the mechanical and fluid friction inherent in such a working cycle. The mechanical complexity of this engine makes it costly to manufacture.

In another attempt (Vivian, U.S. Pat. No, 4,174,683), the induction valve in the working cylinder of the engine is kept open during part of the compression stroke and thereafter closing the valve and compressing only a fraction of a full charge which is then ignited and expanded against the piston to the full volume of the cylinder. This process is very complex requiring means for both changing the point of axis of the crankshaft and for altering the intake valve timing according to load demands. Furthermore, no means of increasing compression or charge turbulence is provided. This concept continues to operate with the friction inherent in the four-stroke cycle engine. In addition, the operation of this engine at full load is the same as for a conventional engine so that it offers improved characteristics at part load only.

Others have attempted to extract more shaft work from combustion gases using similar systems of conducting the burned gases into other cylinders after firing for additional expansion, also with similar results. Some have tried burning charges in one-half the cylinders of a multi-cylinder engine and then ducting the exhaust from the firing cylinders into the remaining half of the cylinders for the extraction of additional shaft work. To date none of these attempts has been successful and emissions were generally increased over conventional engines.

Rotary engines have also been patented which strive to gain the same advantages. One such is the new Wankel engine, U.S. Pat. No. 3,688,749 issued in 1972, in which a charge is compressed in one chamber of the rotor of a four-lobed rotor engine where the charge is ignited and expanded first in the initial chamber and then through a duct into the next down-stream chamber. Some of the problems with this concept are that the second expansion chamber is already half filled with recompressed exhausted gases from the previous firing and there are extensive throttling losses in transferring the charges.

BRIEF DESCRIPTION OF THE INVENTION

The present invention provides a reciprocating internal combustion engine comprising a compressor chamber for compressing an air charge, power chambers in which combustion gas is ignited and expanded, a piston operable in each chamber and connected to a crankshaft by connecting link means for rotating the crankshaft in response to reciprocation of each piston, a transfer manifold communicating said compressor chamber with said power chambers through which manifold the compressed charge is transferred to enter the power chambers, an admission valve controlling admission of air to said compressor chamber for compression therein, an outlet valve controlling admission of the compressed charge from the compressor chamber to the transfer manifold, an intake valve controlling admission of the compressed charge from the transfer manifold to said power chambers, and an exhaust valve controlling discharge of the exhaust gases from said power chambers, said valves being timed to operate such that the air charge is maintained within the transfer manifold and introduced into the power chamber without any appreciable drop in charge pressure so that ignition can commence at substantially maximum compression, means being provided for causing fuel to be mixed with the air charge to produce a combustible gas, means being provided for ignition of the combustible gas, and wherein said compressor chamber and the combustion chambers of said power chambers are sized with respect to the displaced volume of said power chamber such that the exploded combustion gas can be expanded substantially beyond its initial volume.

The chief advantages of the present concept over existing internal combustion engines are: the compression ratio for spark ignited engines can be increased without the attendant problem of combustion detonation, the expansion ratio for both spark ignited and compression ignited engines is greatly increased, and a much greater charge turbulence is produced in the combustion chamber of both.

The higher compression, the more extensive expansion process and the increased charge turbulence will greatly increase the thermal efficiency of an internal combustion engine according to this invention at all loads, whilst at the same time providing a cleaner exhaust. These features are enhanced by extra power strokes produced per revolution of the engine crankshaft (50% more in the 4- and 8-cylinder arrangements and 33% greater in the 3- and 6- cylinder configuration, as described in detail herein). Higher compression and the possibility of operation without a liquid cooling system should provide an engine having approximately the same power-to-weight ratio as that of a conventional engine of the same power rating even though charge weight is reduced. (One design should produce a much greater power-to-weight ratio than conventional engines.) Experimental data indicate that a change in compression ratio does not appreciably change the mechanical efficiency or the volumetric efficiency of the engine. Therefore, any increase in thermal efficiency resulting from an increase in compression ratio will be revealed by a corresponding increase in torque or mean effective pressure (mep); this power increase being an added bonus to the actual efficiency increase.

The extra power strokes per revolution of crankshaft translates into a nominal $2\frac{2}{3}$ stroke cycle engine in the 4- or 8-cylinder design and produces a nominal 3-stroke cycle engine in the 3- or 6-cylinder design for reduced friction and greater mechanical efficiency.

BRIEF DESCRIPTION OF DRAWINGS

Embodiments of internal combustion engines according to the invention will now be described, by way of example, with reference to the accompanying drawings, in which.

DESCRIPTION OF DRAWINGS

Figure 1:
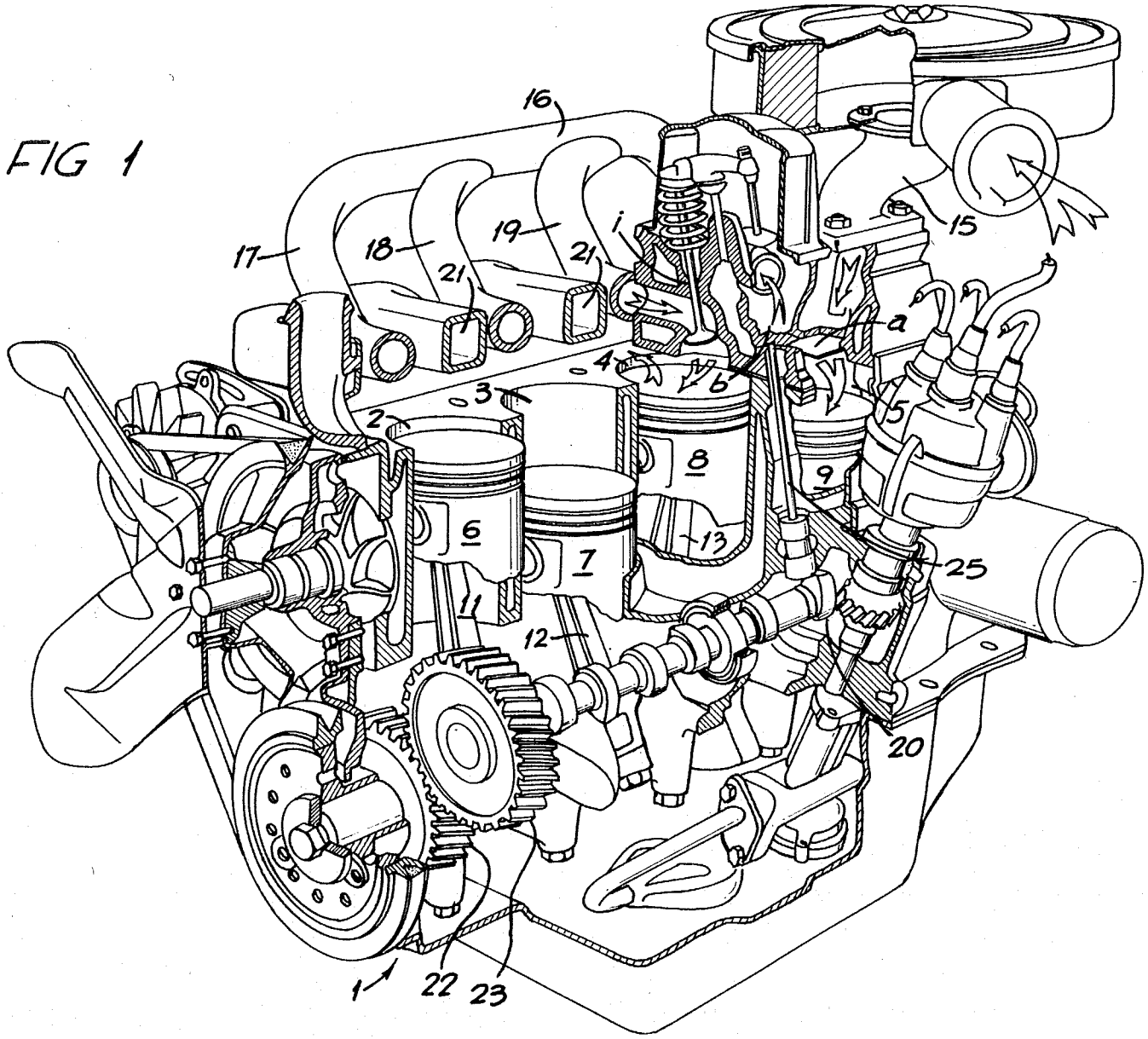
FIG. 1 is a perspective view of the cylinder block of a four-cylinder internal combustion engine according to the invention.

Referring to the drawings, FIG. 1 shows a four cylinder reciprocating internal combustion engine for gasoline, diesel, gas or hybrid dual-fuel operation and having four cylinders 2–5 in which pistons 6–9 respectively are arranged to reciprocate. Pistons 6–9 are connected to a common crankshaft 10 in conventional manner by means of connecting rods 11–14, respectively. Engine 1 is adapted to operate in a 2-stroke cycle so as to produce three power strokes per revolution of the crankshaft 10. To this end one cylinder 5, functions as a compressor, so that during operation of the engine, compressor cylinder 5 takes in an air charge at atmospheric pressure, or alternatively an air charge which previously has been subjected to supercharging to a higher pressure, via an admission control valve 'a', through an intake conduit 15. During operation of the engine 1, the air charge is compressed within the compressor cylinder 5 by its associated piston 9, and the compressed charge is forced through outlet valve 'b' into a high-pressure transfer manifold 16. Manifold 16 is constructed and arranged to distribute the compressed charge by means of branch conduits 17, 18 and 19 and intake valves 'i' to the three remaining (expander) cylinders 2, 3 and 4 respectively which produce the power of the engine.

The volume of the combustion chamber of each expander cylinder 2, 3 and 4 is preferably sized to be no larger than one third that of a conventional engine having a similar compression ratio. This is because the total volume of the combustion chambers should not exceed the volume of charge compressed by the compressor piston and therefore no appreciable expansion of the gases will occur before combustion takes place.

Engine 1 has a camshaft 20 which is arranged to be driven at the same speed as the crankshaft in order to supply one working stroke per revolution for both power and compressor pistons, as described hereinafter.

Figure 5:
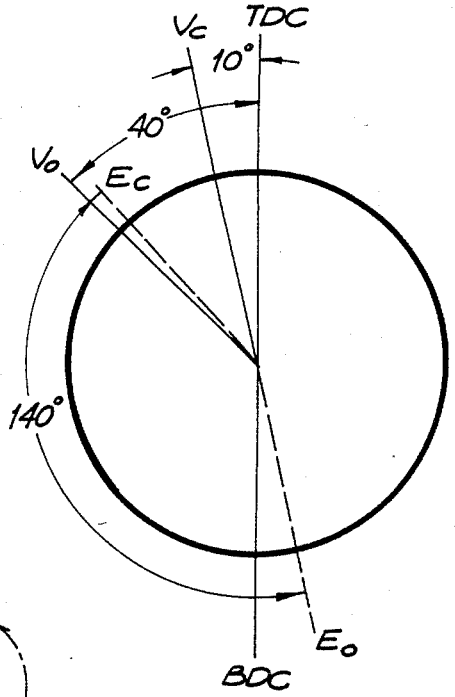
FIG. 5 is a diagram showing suggested valve timing for the engine shown.

The operation of the engine is as follows:

The intake valve 'i' of each power cylinder is timed to allow the charge to begin entering at approximately 40° before top dead center (BTDC) (see FIG. 5) and the exhaust valve is timed to close at approximately the same crank angle. The intake valve may open earlier or the opening time may be varied according to the speed of the engine. A compressed air charge in transfer manifold 16 enters the combustion chamber of the cylinder which is to be fired as the advancing piston begins to form the bottom of the combustion chamber without any appreciable pressure drop occurring and at a high velocity during which fuel may be injected simultaneously. The fuel may be injected after intake valve closure on either spark ignited or compression ignited engines. At about 10° BTDC (see FIG. 5) the intake valve is closed and the fuel is ignited either by spark plugs or by means of auto ignition. Hence, the charge is ignited at maximum compression and the gases expanded against the working cylinder beyond their initial volume.

At the time the intake valve opens, at about 40° BTDC, the piston has completed about 90.5% of its exhaust stroke leaving only 9.5% of its displacement volume, plus the diminutive combustion chamber volume unoccupied. The air charge will have a velocity similar to that of the rising piston and virtually no expansion of the charge will take place before the piston reaches top dead center (TDC). The advancing piston prevents admission of a charge volume which is appreciably greater than the volume of the combustion chamber (whose pressure equilibrates with the manifold-reservoir pressure) at the time of the closing of the intake valve 'i', at about 10° BTDC. Combustion will begin before top dead center (BTDC) for the utmost in efficiency. As stated, in this particular arrangement if the compression ratio is 16:1 the expansion ratio will be 48:1. Therefore, the gases are expanded to three times their initial volume, the compression ratio being established by the volume of the three combustion chambers in relation to the total displaced volume of the single compressor cylinder.

The exhaust gases are discharged via an exhaust manifold 21 and the scavenging would be extremely efficient. In a conventional 4.2 liter 8 cylinder automobile engine each piston displaces about 89.4% of its total cylinder volume in the exhaust stroke (displaced volume/total volume). Similar scavenging efficiencies can be realized in the engine according to this invention. For example, if the intake valve 'i' opened at 40° BTDC and the exhaust valve closed at 40° BTDC the stroke of the piston would be 90.54% complete. Therefore, 90.54% of the displacement volume of 522.3 cc (same 4.2 liter engine) is 472.9 cc. This amount divided by the total volume of the cylinder of the engine of this invention is 87.8% of volume displaced (and scavenged).

Figure 3:
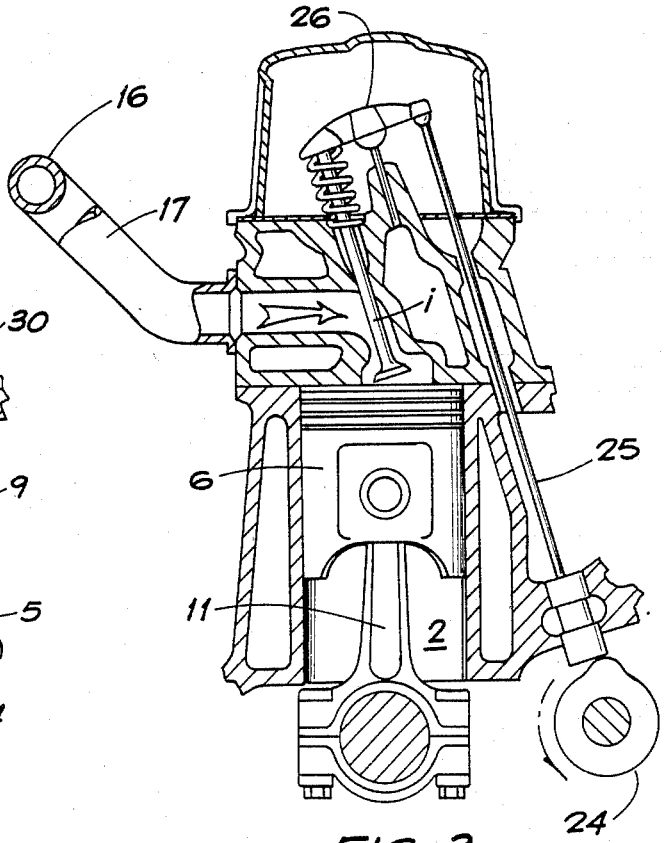
FIG. 3 is a part sectional view through one power cylinder of the engine at the intake valve.
Figure 12:
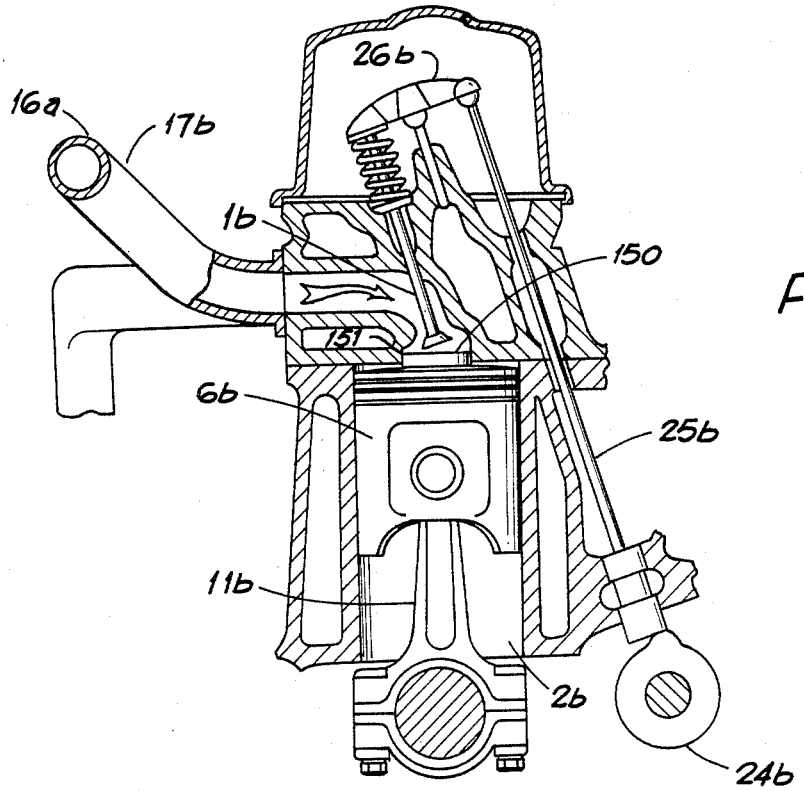
FIG. 12 is a part sectional view through one power cylinder of the engine at the intake valve in which a projection is affixed to the crown of the piston.
Figure 13:
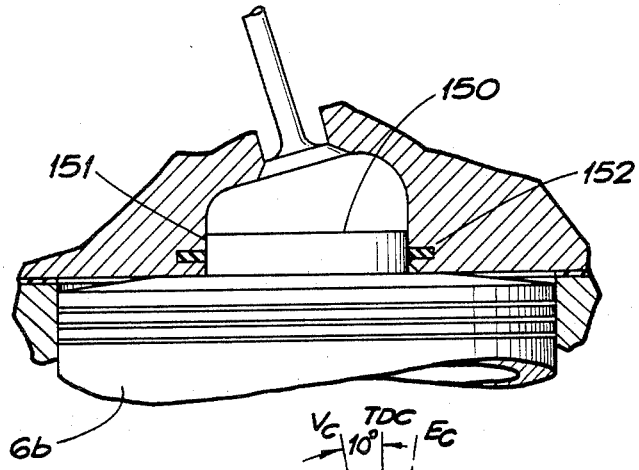
FIG. 13 is an expanded view of the projection on the piston and combustion chamber of FIG. 12.

Referring now to FIG. 12, there is shown a similar engine arrangement to that illustrated in FIG. 3 in which like parts are designated like reference numerals with the addition of suffix 'b' and in which a projection 150, FIG. 12, affixed to the crown of expander cylinder piston **6*b*, closes the opening of the combustion chamber 151 at somewhere near 40 degrees before top dead center (BTDC) as piston 6*b* rises in its exhaust stroke. This arrangement facilitates exhaust scavenging by allowing the exhaust valve to remain open past TDC and by virtually displacing all of the burned gases while preventing the charge, which is passing the intake valve into the combustion chamber, from entering the cylinder proper. The projection 150 may be fitted with a compression ring or a compression ring 152 may reside inside the opening of the combustion chamber as shown in FIG. 13**.

Figure 14:
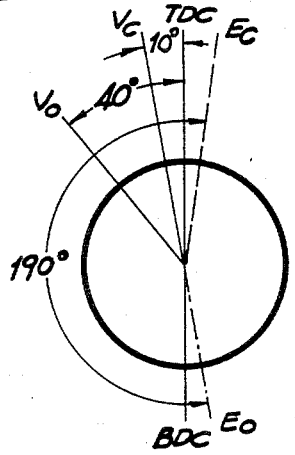
FIG. 14 is a diagram showing suggested valve timing for an engine with a power cylinder as shown in FIG. 12.

FIG. 14 is a diagram for suggested valve timing and can be used with the arrangement shown in FIG. 12 for improved scavenging for all of the designs of this invention. The suggested operation is in this manner. In the expander cylinder (FIG. 12) the exhaust valve opens near bottom dead center (BDC) and as the piston **6*b* rises, it expresses the burned gases through the exhaust valve 'e' (not shown) about 40 degrees before top dead center (BTDC), the intake valve opens, at approximately the same time the projection 150 on top of the piston occludes the outlet of the combustion chamber 151 effectively sealing it. At this time (40 degrees BTDC) the piston has completed 90% of its scavenging, therefore, it only has 10% of further travel. If the piston stroke is four inches, then the amount of stroke remaining would be 4/10 inch. Therefore, the projection on the piston would need be only 4/10ths inch high to seal the combustion opening as the intake valve opens at 40 degrees BTDC. As illustrated in FIG. 14**, the exhaust valve can remain open as much as 30 degrees past TDC. The intake valve could be opened earlier or later and the intake valve opening time could be varied with engine speed.

The diagram in FIG. 14 illustrates valve timing in which at 40 degrees BTDC the projection 150 on piston **6*b* closes combustion chamber port 151 and at the same time fresh charge begins to enter intake valve 'i'. The piston continues to rise until there is practically zero clearance with the face of the engine head, expelling virtually all of the exhausted gases. During the 40 degrees of crank rotation the intake valve is opened, pressure equilibrium is established between the combustion chamber 151 and the manifold 16*b*. At 5–10 degrees before top dead center, the intake valve closes and fuel is injected and ignited at maximum compression for greatest efficiency. Shortly after top dead center (TDC) the exhaust valve 'e' closes. The pressure of the burning gases is expanded against first the piston valve crown 150** and then into the cylinder and against the entire piston crown after the crank angle is 40 degrees past top dead center. The charge is expanded against the piston for the full length of the expansion stroke.

The compression ratio is established by the total volume of all of the combustion chambers which are supplied by a single compression cylinder, divided into the displaced volume of the single compressor cylinder. For a 2 liter four cylinder engine, this would be 500 cc divided by 31.25 for a compression ratio of 16:1. The combustion chamber volume of this engine would be only 10.4 cc per cylinder or the 31.25 cc for the three firing cylinders. (These figures would be adjusted to reflect compressor efficiency.)

Although the intake manifold 16 must withstand high pressures this will not add to the weight of the engine because the volume of air charge flowing through it should not be more than 1/16th to ⅛th of the volume passing through the manifold of a conventional engine as the charge is already partially, or preferably, completely compressed. This small volume of charge allows the manifold to have a small inside diameter. The manifold 16 should be small enough for the heavier charge to have sufficient velocity to charge the expander cylinders 2, 3 and 4 but nevertheless should have enough volume so that there would be no appreciable pressure drop when an expander cylinder is charged. When the intake valves 'i' to the power cylinders open the pressures in the combustion chamber and in the manifold equilibrate.

With the small volume of air charge introduced into the combustion chambers the intake valves 'i' of the engine 1 can be smaller and lighter (requiring lighter springs) and indeed may be shrouded with no loss of volumetric efficiency. Other means besides shrouding for providing a tangential charge direction can also be used.

Although the intake valve will be open for a short time only (such as 30° or 40°), this will be about ⅛th of the time (or crank angle) that a conventional Otto cycle engine intake valve is normally open. Yet, the volume of charge passing the intake valve, assuming a 16:1 compression ratio, is only 1/48th (one-third of the normal charge already compressed) of the volume passing the intake valve of the Otto cycle engine. In the three or six cylinder engine the volume entering the combustion chamber will be only 1/32 that passing the intake valve of a conventional engine.

Fuel may be injected directly into each of the expander cylinders 2, 3 and 4 or into the individual inlet ports. The quantity of fuel may be made proportionate to the engine operating conditions by varying the effective stroke of the fuel pump, by varying the opening time of a fuel injection nozzle fed from a constant pressure main or by varying the rate of flow through the injection nozzle.

Alternatively, a carburetor may be placed in front on the compressor cylinder 5 and used for maintaining the ratio of fuel to air in the region of the stoichiometric ratio.

In the gas or spark ignited version or mode the engine may be throttled near the atmospheric intake conduit 15 by means of a butterfly valve (not shown) in order to prevent the engine wasting work by having to compress more air than needed to maintain the stoichiometric fuel to air ratio. A means is described later for reducing or eliminating throttling in the spark ignited version or mode.

For spark ignition compression ignition operation, the speed could alternatively be controlled by the fuel rate alone. Thus automatic fuel air ratio control would not be required and throttle valves could be eliminated.

Figure 2:
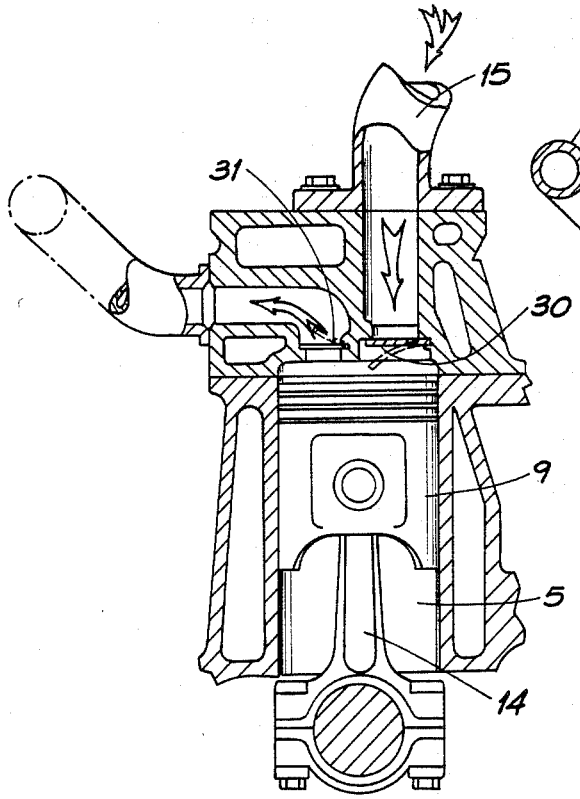
FIG. 2 is a part sectional view through the compressor cylinder of the engine shown in FIG. 1.

FIG. 2 shows one means of utilizing automatic one-way valves in the compression cylinder 5. While reed type valves 30 (admission), 31 (outlet) are illustrated on the compressor cylinder 5, other valve types, such as sliding valves or sleeve valves could be used.

FIGS. 3 and 12 of the drawings illustrate one means of operating the intake valve 'i' of the power cylinders of the engine with reference to cylinder 2. The speed of the camshaft 20 is arranged to be the same as that of the crankshaft 10 and is driven from the crankshaft by a gear 22 on the crankshaft and sprocket drive 23 shown in FIG. 1. Large cam 24 or **24*b* operates push-rod 25 or 25*b* and rockerarm 26 or 26*b*** to activate intake valve 'i' which preferably opens at about 40° BTDC and closes at about 10° BTDC.

Figure 4:
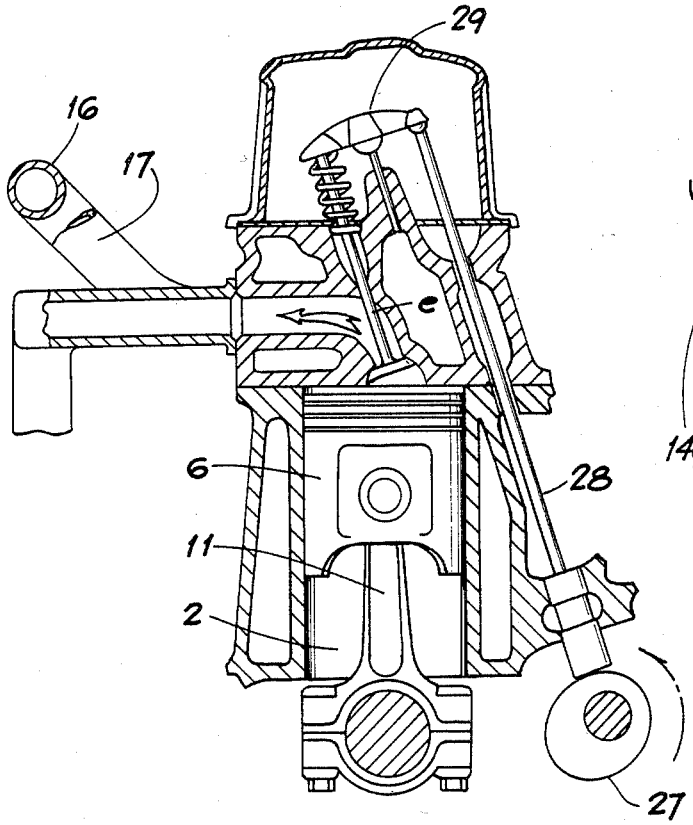
FIG. 4 is a part sectional view through one power cylinder of the engine at the exhaust valve.

FIG. 4 shows how cam 27 operates push-rod 28 and rockerarm 29 to activate exhaust valve 'e' which opens at approximately bottom dead center (BTDC) and closes at 40°–35° BTDC in the first design. In the alternate design, the exhaust valve may be held open past top dead center for better scavenging if desired as illustrated in FIGS. 12 and 14.

Figure 7:
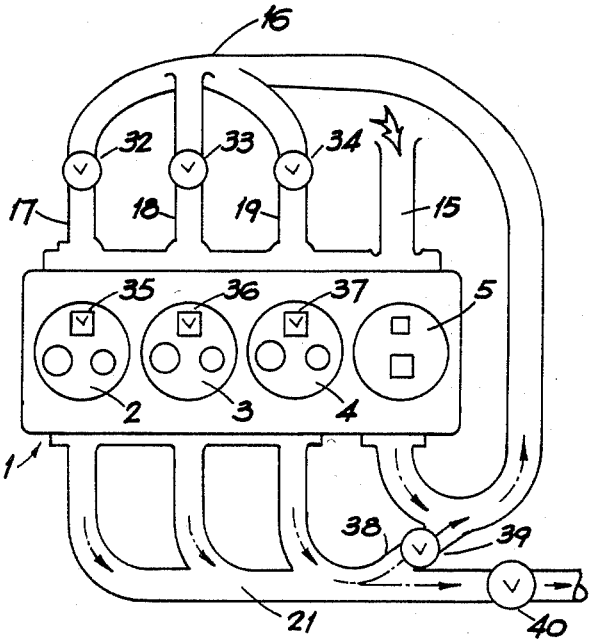
FIG. 7 is a schematic plan view of a similar four cylinder engine modified to allow quick compression build-up.

To facilitate starting the engine, quick compression build-up in the manifold could be achieved if necessary, by momentarily blocking the intake to the expander cylinders (FIG. 7). One means could be that the intake valves of the expander cylinders 2, 3 and 4 could be deactivated (there are several methods of doing this in the art, some of which are described later). Also, one way blocking valves 32, 33 and 34 (FIG. 7) could be placed in each branch of the transfer manifold 16 and closed. Alternatively, sliding valves could be placed between the transfer manifold and the inlet ports of the cylinders and closed. Moreover, one way valves 35, 36 and 37 can be placed between each expander piston and the associated intake valves to allow each expander piston to pull in atmospheric air unrestricted while the engine manifold was being charged. (If blocking is done ahead of the intake valves, the valves 35, 36 and 37 can be placed between the blocking valves and the intake valves 'i' if means are provided to also hold the intake valves 'i' open during the downstroke of the expander piston during compression build-up in the manifold.) Furthermore, a bypass line 38 with a one-way valve 39 and a blocking valve 40 could be placed in the exhaust manifold 21 in order to direct the pumped air into the manifold 16 for quicker build-up of compression.

A second means to facilitate fast starting would be to open a valve leading from a compressed air reservoir to the cylinders. This would supply compressed air for instant firing of the cylinders. The air reservoir could be supplied by an air-compressor retarder brake described with reference to FIG. 11 or by any other method.

In order to produce fast burning efficient combustion, velocities of the compressed air in each manifold branch conduit 17, 18 and 19 should be high and charge velocities in the combustion chamber up to sonic velocities may be achieved. Tremendous swirl and squish can be produced in the combustion chamber by controlling the angle of the inlet port with respect to the cylinder radius or by the use of a shrouded intake valve.

The resulting turbulence helps promote combustion by intermixing burned and unburned gases at the flame front as it progresses across the combustion chamber. This feature alone should make $NO_x$ and HC emissions negligible and virtually eliminate CO emissions. The extra burning time of the extended expansion process should then further reduce HC emissions to only a trace.

Figure 8:
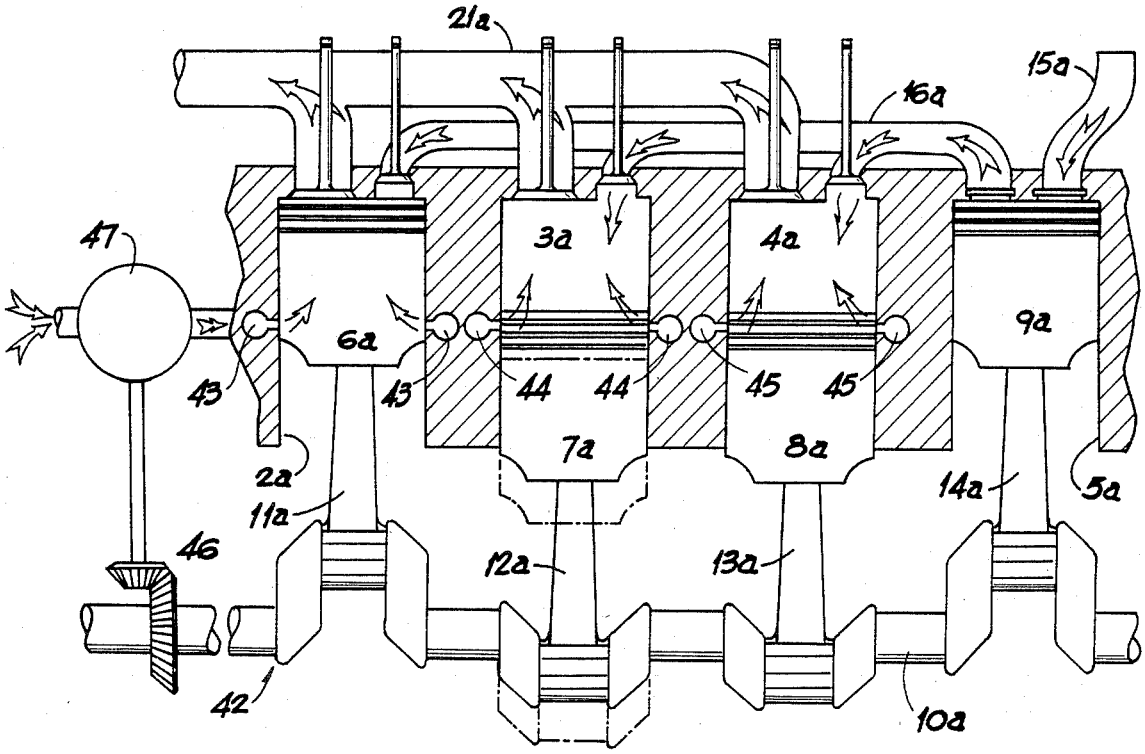
FIG. 8 is a schematic transverse sectional view of the cylinder block of a modified four cylinder engine.

Referring now to FIG. 8 of the drawings, there is shown a similar 4-cylinder engine 42, in which like parts are designated like reference numerals with the addition of suffix 'a', and in which additional cylinder end exhaust ports 43, 44 and 45 are provided in the walls of the expander cylinders **2*a*, 3*a* and 4*a* respectively, in order to improve the scavenging efficiency. Such ports 43–45 would be uncovered by their associated pistons 6*a*–8*a* respectively at the lowest point of the piston stroke. As the exhaust ports 43–45** are uncovered, the pressure in the cylinders could expel much of the exhausted gases to the atmosphere through a common exhaust manifold (not shown).

Alternatively, a step-up gear set 46 can be placed on the crankshaft 10*a* and geared to drive a scavenging type blower 47 in order to inject fresh air into the ports 43–45 as they are uncovered by their associated pistons **6*a*–8*a*, respectively. In this arrangement, the associated exhaust valves of each power cylinder 2*a*–4*a* would be opened at approximately the same time as the ports 43–45** were uncovered.

In this invention, the exhaust valves are open from before BDC until about 40°–45° BTDC and the piston itself displaces (scavenges) 90% of the burnt gases through the exhaust valves. Therefore, if the blower system 46–47 is added, only a small amount of fresh air need be supplied in order to drive some of the burnt gases through the exhaust valve and to dilute the remainder of the gases which are then scavenged by the stroke of the associated piston.

These arrangements would provide for cooler exhaust valves and allow the exhaust valves to be closed earlier. In this way, the intake valves could be opened earlier.

In a further arrangement the single compressor cylinder could be double acting (now shown) although the basic operation of the engine would remain the same. In this arrangement, the compressor cylinder would compress an air charge to a volume sufficient to supply the three power cylinders with one-half to two-thirds of the normal volume of charge depending on the expansion ratio required.

It is also envisaged that a 5-cylinder engine in which one of the cylinders comprised a double acting compressor cylinder would supply four expander (power) cylinders whose combustion chambers are half the volume of a conventional engine. This arrangement will produce four power strokes per revolution with the expansion ratio being twice the compression ratio.

Furthermore, in an 8-cylinder reciprocating engine any of the 4-cylinder constructions described above could be doubled or alternatively three compressor cylinders could compress the air charge for five power cylinders. The former would produce six power strokes per revolution and the latter would produce five. In the latter case the combustion chambers could be from 50% to 60% of normal volume according to the expansion ratio desired.

In any of the engine constructions described herein the engines may be fueled by means of gasoline, gas or diesel or indeed the engine can be constructed for hybrid operation as a multi-fuel engine. In any event the smaller charge exploded would permit a lighter construction for the compression ignition engine arrangement and will also provide quieter operation for compression ignition (CI) engines.

Figure 9:
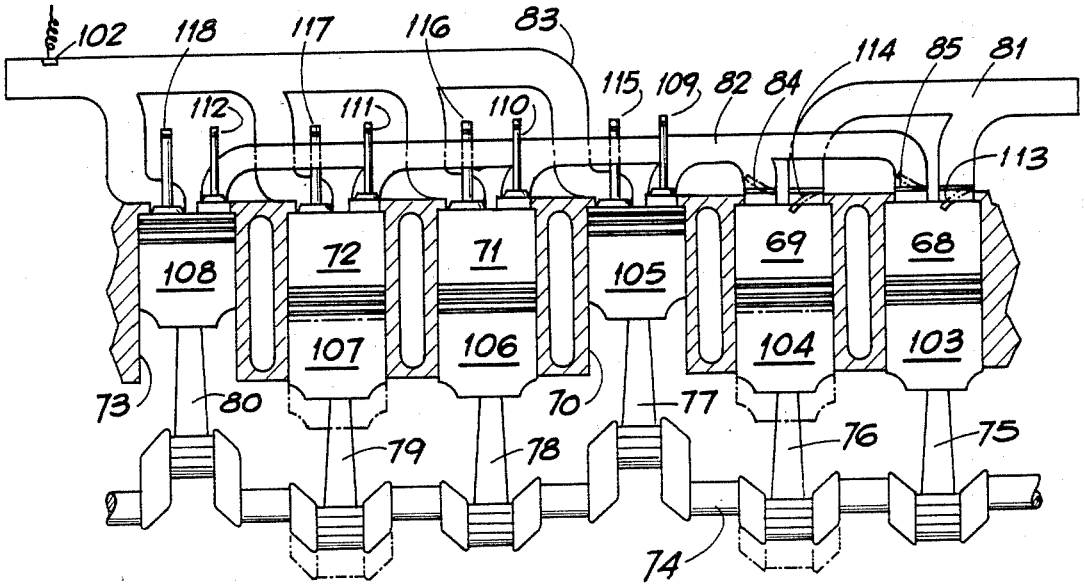
FIG. 9 is a schematic transverse section of a 6-cylinder engine having two compressor cylinders and four power cylinders.

Referring now to FIG. 9 of the drawings, there is shown a schematic transverse sectional view through a six cylinder internal combustion engine having two compressor cylinders 68 and 69 and four expander (power) cylinders 70, 71, 72 and 73 and associated pistons 103, 104, 105, 106, 107 and 108 all connected to a common crankshaft 74 by means of connecting rods 75–80 respectively.

The operation of an engine constructed according to this arrangement is similar to that previously described in that air at atmospheric pressure or supercharged to a higher pressure is supplied to the compressor cylinders 68 and 69 via an inlet conduit 81 through admission control valve 113 and 114 and the air is compressed by way of outlet valves 84 and 85 into a high pressure transfer manifold 82 which supplies the compressed charge to the expander cylinders 70 to 73 through intake valves 109–112. Therefore, each of the compressor cylinders 68 and 60 supplies two expander cylinders.

The combustion chambers of the expander cylinders are preferably dimensioned to be no more than one-half the volume of that of a conventional engine at a similar compression ratio and therefore the expansion ratio of the engine is at least double that of a conventional engine. For example, at a compression ratio of 16:1 the combustion chamber would be about one-quarter the volume (one-half the normal charge compressed to the higher ratio) of an ordinary engine and the expansion ratio would be 32:1.

Each cylinder is a two-stroke cylinder and is scavenged by displacing the burnt gases during the exhaust stroke of the piston. Hence, virtually no air is used in scavenging. The working piston rises displacing the exhaust gases via an exhaust manifold 83, the associated intake valves (109–112) open as the piston begins to form the combustion chamber so that the charge begins to flow at about 40° BTDC and the associated exhaust valves (115–118) close at about 40° BTDC. The enhanced scavenging system illustrated in FIGS. 12 and 14, and described more fully in the description of the engine of FIG. 1, would allow the exhaust valves to remain open past top dead center without allowing the mixing of incoming charge and exhaust gases. The intake valve can have a shroud on one side which directs air charge flow into a very turbulent swirl as previously described. Fuel is injected at the time the intake is in progress or as soon as the intake valve is closed at abut 10° BTDC. When the intake valve closes the charge is ignited by spark plug or by means of auto ignition. The volume of the entering air charge, in the preferred embodiment, is no greater than 1/32nd of that passing through the intake valve of a conventional engine and therefore a good volumetric efficiency is achieved. This gives each of the expander cylinders 70 to 73 one power stroke per revolution so that a total of four power strokes per revolution is produced by the six cylinder engine which, of course, is equal to the number of power strokes of a conventional four-stroke eight-cylinder engine.

Figure 6:
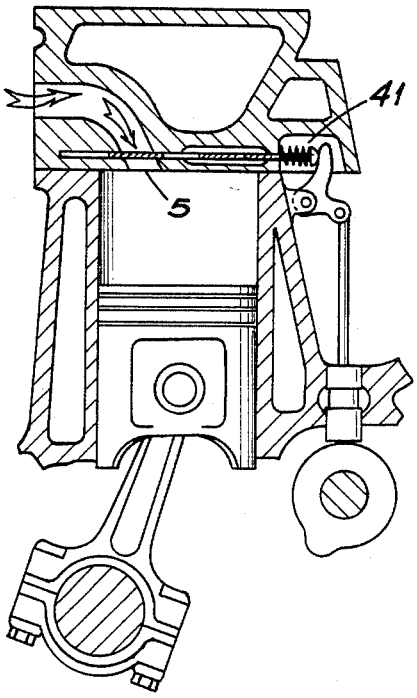
FIG. 6 is a transverse sectional view through an alternate embodiment for a power cylinder showing a sliding valve.

The valves of the power cylinders could be operated as shown in FIGS. 1, 3 and 6 or in the system illustrated in FIGS. 12 and 14. The compressor cylinders could be arranged as shown in FIG. 2. Preferably the manifold 82 would be insulated for compression ignition operation.

As in the other designs the timing of the intake valve opening may be advanced or retarded as required or indeed may be varied during operation as may be required in a variable speed or variable load engine. There are means described in the art for varying both the moment and the duration of valve happenings.

A three cylinder engine arranged to operate in a similar manner to the six cylinder engine just described is also envisaged. In this event only one compressor cylinder would be provided which would supply a compressed air charge to two expander cylinders thus producing two power strokes per revolution to equal the smoothness of a four-cylinder four-stroke cycle engine. This arrangement would be the same as shown in FIG. 1 with one power cylinder removed and the volume of the combustion chambers would ideally be no greater than one-half that of a conventional engine at a similar compression ratio. Either of the two schemes of FIGS. 4 and 5 or FIGS. 12 and 14 may be used for scavenging.

In any throttled engine of this invention, reduced throttling can be achieved if the engine has a plurality of compressor cylinders in the following manner. At any time the atmospheric air intake manifold pressure dropped appreciably below ambient pressure, for example if half throttled, the outlet from one or more of the compressor cylinders could be closed by a shut-off valve. Work done in compressing this captive charge is recovered as the charge expands on the back stroke of the piston with zero net induction pumping done by that cylinder.

Pumping work created by throttling would be greatly reduced thereby and intake manifold 81 pressure will remain more nearly constant at all output loads, particularly over the range including idle and one-third of maximum power output where most engine loading occurs during typical automotive operation. This method could be used with any multiple of the four cylinder or three cylinder arrangement.

Throttling may be eliminated completely in spark ignited engines as illustrated in FIG. 1 by providing late fuel injection into the combustion chamber and allowing combustion to begin in the injected spray. The violet swirling motions of the gases will insure that very lean mixtures will burn completely. Alternatively, if the spark plug is placed downstream from the fuel injector and is sparked at the same time as the fuel is injected into the swirling charge, the flame front will remain static just past the plug, burning the fuel as it passes and would provide an end-gas downstream which would contain no fuel which could detonate.

Figure 10:
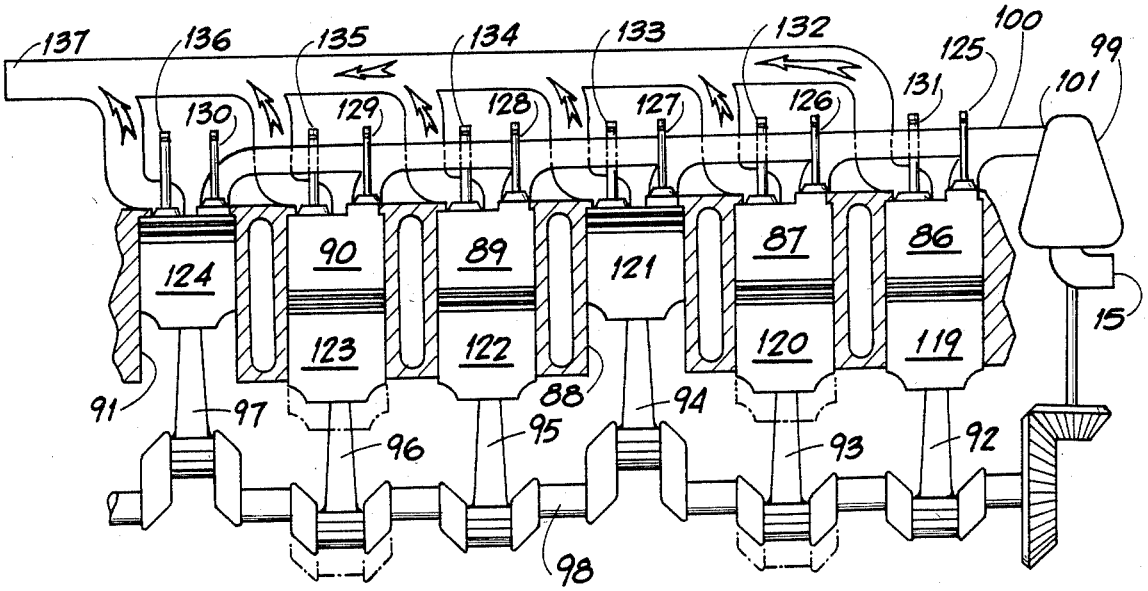
FIG. 10 is a schematic transverse section of a 6-cylinder engine having six power cylinders supplied with a compressed air charge by a separated compressor.

Referring now to FIG. 10 of the drawings there is shown a six-cylinder reciprocating internal combustion engine in which all the cylinders 86–91 and associated pistons 119–124 operate on a two-stroke cycle and all cylinders are used for producing power to a common crankshaft 98 via connecting rods 92–97 respectively.

This engine is characterized by a more extensive expansion of the burned gases and a greater charge turbulence with combustion beginning at maximum compression. In the case of gasoline operation the engine can operate at a higher compression ratio than is usual.

In this two stroke design the cylinders are scavenged by positive displacement with virtually no loss of air charge or fuel in the scavenging process. The greater expansion ratio, higher compression ratio and increased charge turbulence produces a more fuel-efficient engine while providing greater power to weight ratio than that of the Otto cycle engine.

The engine is constructed much the same as a four-stroke cycle internal combustion engine but with a number of significant differences. The combustion chamber of each cylinder is preferably made no greater than one-half to one-third the usual size for the compression ratio desired and according to the expansion ratio decided upon. The cam shaft (not shown) is geared to turn at the same speed as the crankshaft in order to open and close the inlet (125–130) and exhaust (131–136) valves once during each revolution of the crankshaft. Compression takes place in one or more stages before the air charge is admitted to the combustion chambers of the cylinders and the intake manifold becomes a high pressure manifold reservoir. Fuel injectors are used to inject fuel except for natural gas or propane operation which can be mixed in an EMPCO type carburetor. An efficient high compression air compressor 99 is placed between the air intake 15 and the cylinders. The compressor could be geared to a crankshaft common to the power cylinders as shown in FIG. 10.

It is also envisaged that any external source of compressed air can replace the compressor 99 and therefore the engine can operate on waste compressed air for further fuel economy.

The pressure ratio can be increased at will until the pressure ratio (nominal compression ratio) is equal to or surpasses the expansion ratio for greater power as the load demands. This could be accomplished simply be increasing the speed of the compressor.

One of the most important elements needed for success in this design is to provide a compressor which will produce both the pressures and the quantity of air charge needed for efficient operation and any suitable compressor is within the scope of this invention. It is envisioned that three stages of radial compression would be economical and ideal for compression ignited engines.

The operation and function of the six-cylinder engine depicted in FIG. 10 of the drawings is as follows: the compressor 99 aspirates air and compresses it into the manifold-reservoir 100. A check valve at 101 may be used if compressor pressure pulsations are great. The manifold reservoir 100 contains such a volume that there is no appreciable drop in overall pressure as the cylinders 86–91 are charged sequentially. As the engine is cranked the piston ascends to about 40° BTDC (see valve timing schemes shown in FIGS. 5 and 14) which displaces the gases when its travel is almost to the end of its associated cylinder. This expels 90% of the burnt gases through the exhaust valve (into the exhaust manifold 137) which opens as the piston begins its exhaust stroke. The piston is then at about 40° BTDC. The intake valve then opens and an increment of the compressed air charge enters through a valve as the piston continues its stroke which is 90% complete. Fuel can be injected at the same time (or as soon as the intake valve is closed). The high pressure air, the persistency of the flow and the small volume of the charge (about 1/32nd to 1/48th of the volume which normally passes an intake of a conventional engine) assures a high volumetric efficiency. The intake valve then closes at about 10° BTDC and the mixture is ignited. In this manner combustion begins at maximum compression but the air charge has at least two to three times the expansion of an equivalent Otto cycle engine. It will be appreciated that if the combustion chamber is made half the normal volume the expansion ratio will be twice the compression ratio and a one-third normal volume combustion chamber will triple the expansion ratio. If the compression ratio is 16:1, the expansion ratio can be either 32:1 or 48:1, respectively. Enhanced scavenging may be achieved if desired by use of the scavenging system shown in FIGS. 12 and 14. In this scheme the mouth of the combustion chamber is blocked at about 40° BTDC and the exhaust valve is held open past top dead center, and the intake valve is opened at the time the combustion chamber is blocked. This scheme is better described in the description of the engine in FIG. 1. Valve timing may be varied if desired.

Although less air charge is used, a correspondingly smaller increment of fuel is used. The farther the gases expand against a piston the more work is done on the piston and the more complete is the combustion and the cooler is the exhaust gases. In a conventional diesel engine approximately 100% excess air is aspirated at full load but the lack of turbulence and time hinders complete mixing of the oxygen and fuel. In the present engine design the tangential entrance of the high velocity air as previously referred to permits complete mixing of the fuel air charge which together with the more extensive expansion gives more complete combustion and, of course, the density of the air can be increased at any level deemed efficient.

A variable ratio transmission gear set (not shown) can be placed between the crankshaft 98 and the compressor 99 of the engine of FIG. 10 in order to vary the weight of the charge to load demand. During heavy load operation, the nominal compression ratio would be increased by increasing compressor speed until the compression ratio equaled or exceeded the expansion ratio. The speed of the compressor would be decreased during normal operation such as cruising in order to operate in the economical extended expansion mode.

It is further envisaged that a reciprocating internal combustion engine according to any of the designs of this invention may have only one compressor cylinder for use in charging a single expander (power) cylinder, i.e., a two-cylinder engine. In ths case, the expander cylinder would be of greater volume than the compressor cylinder.

Higher than normal compression ratios can be utilized in the gasoline engines of this invention for the following reasons. The charge being compressed outside the hot firing cylinder will be cooler to begin with (it also will require less power to compress this cooler charge) which causes a corresponding decrease in temperature of the end-gas at peak pressure. Extreme charge turbulence causes mixing of the burned and unburned gases at the flame front greatly increasing the flame speed and allows the flame front to reach any end-gas before the pressure wave arrives. The much smaller combustion chamber ($\frac{1}{4}$ to 1/6 normal size) presents a much shorter flame path from the spark plug to the end gas, further assuring arrival of the flame front ahead of the pressure wave. Furthermore, the greater expansion of the gases produces a cooler exhaust valve which is in the region of the end-gas which again reduces the chance of detonation. This also reduces the peak pressure temperature. The nominal time between start of compression and peak pressure is much less since compression is done outside the firing cylinder which fact gives the fuel less residence time for pre-knock conditions to occur.

Alternatively, the following system may be used. The air charge will have such rapid swirl that if fuel injection takes place at the time of sparking and upstream of the spark the burning of the fuel can take place as injection proceeds with the flame front remaining static just downstream of the spark plug leaving no fuel in the end gas.

Pre-ignition will not be a problem in the engine of these designs because the residence time of the fuel is less than that required for pre-ignition to occur.

The power of compression ignition engines operating in this working cycle can be greatly increased by supercharging. The inlet pressure can be boosted from a slight boost up until the theoretical compression ratio equals or surpasses the expansion ratio. Some locomotives operate with a supercharge boost of three atmospheres which, with a compression ratio of 12:1, produces a theoretical compression ratio of 48:1.

The power of spark ignition engines can also be greatly increased by similarly boosting the inlet air pressure.

This working cycle may under certain conditions, such as when used in a compression ignition engine at very light loads, result in the combustion gases expanding to pressures less than atmospheric. At such conditions the nominal compression ratio can be increased until it is equal to the expansion ratio by increasing supercharge boost, or the expansion ratio can be decreased by closing off one or more of the expander cylinders. The latter can be done by deactivating their intake and exhaust valves along with their respective fuel injector(s).

In the system suggested for a four-cylinder engine in which the expansion ratio is three times the compression ratio, one expander cylinder could be closed to decrease the expansion ratio to two times the compression ratio. If, under very light loads the pressure at the exhaust valve was still negative, a second expander cylinder could be closed to produce an expansion ratio equal to the compression ratio. With an eight-cylinder engine, one cylinder could be closed at a time for finer control of the expansion ratio.

With the system suggested for the six-cylinder engine, the expansion ratio is double the compression ratio. Under very light loads in the compression ignition engine, one expander cylinder could be closed to decrease the expansion ratio until it is one and one-half times the compression ratio. Two could be closed to produce equal compression and expansion ratios.

There are several systems described in the art for deactivating the poppet valves of a cylinder. The 1899 Daimler auto engine provided such a means by removing an extra member from between the cam follower and the valve lifter push rod. This allowed the valve spring to hold the valve closed until such time as the spring loaded intermediate member was released.

An electronic system of valve control is manufactured by Eaton Corporation and has been used in several automotive engines. This latter system allows the releasing of the rocker arm pivot support in order to deactivate the valve. This system provides electronic controls which can sense exhaust manifold pressure and cut out the necessary number of expander cylinders at such a time the exhaust manifold pressure drops to or below ambient pressure.

When the valves of a cylinder are closed the energy of compression is returned to the shaft during expansion of the same gas. Even if some of the gas contained in the closed cylinder leaks out, there will be an equilibrium established in which the pressure of the contained gas and the ambient atmospheric pressure will interact in such a manner that there will be no net loss of energy. No "flow work" will be done during the time the cylinder(s) are closed.

Alternatively, in any engine in which the gases could expand to a pressure less than atmospheric further economy could be achieved in the following manner. A pressure sensor, 102 in FIG. 9, could be placed in the exhaust manifold and monitored. The fuel rate could then be adjusted so that there would always be a slight positive pressure in the exhaust manifold. This system would work well in a constant load, constant speed engine in particular.

Another means of relieving a partial vacuum at the end of any power stroke would be to utilize the one-way valves 35, 36 and 37 of FIG. 7.

Figure 11:
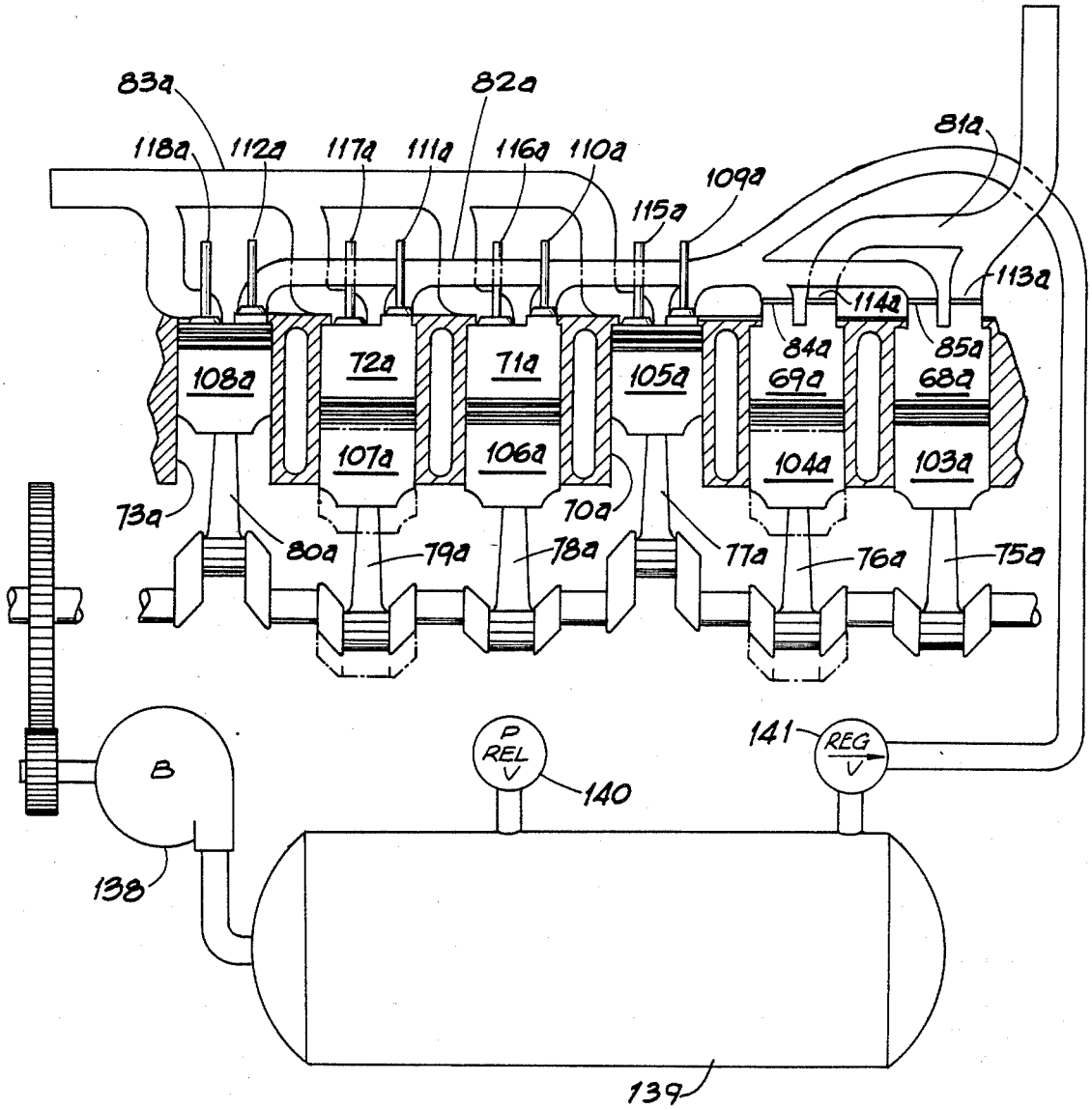
FIG. 11 is a schematic transverse sectional view through a 6-cylinder engine adapted for use with an economizer device comprising an air retarder brake.

Referring now to FIG. 11 of the drawings, additional fuel savings can be achieved in the engines described hereinbefore by use of an economizer constructed as an air compressor retarder brake. This six-cylinder engine is similar to the engine shown in FIG. 9 in which like parts are designated by like reference numerals with the addition of the suffix 'a'. The air retarder brake illustrated has a compressor 138 operatively connected to the drive shaft of vehicle or geared to the engine and stores energy produced during braking or downhill travel which is utilized to supply compressed air to the engine power cylinders via the transfer manifold of 82*a*. Such an economizer would be coupled with an air reservoir 139 and during the time in which the economizer reservoir air pressure was sufficiently high for use in the power cylinders of the engine, the engine compressor could be clutchably disengaged so that no compression work would be required of the compressor. A relief valve 140 prevents excess build up of pressure in the air reservoir. Valve 141 allows air from the reservoir to be transferred to the manifold when the pressure in the reservoir 139 is higher than in the transfer manifold 82*a*. In the case of engine constructions having compression cylinders each compression cylinder of the engine could also be deactivated during this reserve air operation time by shutting off the admission valve so that no net work would be done by the compressor(s) until the manifold-reservoir pressure dropped below operating levels. Several systems of deactivating cylinder valves are described in the art and have been mentioned previously.

Alternately, the compressor 138 could be eliminated and the air storage tank 139 could be used to store excess air compressed by the compressor cylinders of the engine during braking and downhill travel. In this case valve at 141 would be a two-way valve and a blocking valve would be placed in the manifold between the compressor cylinder(s) and the working cylinders. During downhill travel or during braking, the blocking valve between compressor and working cylinders could be closed and the two-way valve at 141 could be utilized in order to divert the air compressed by the compressor cylinder(s) into storage tank 139.

When it was desired to operate the engine normally, the blocking valve between the compressor and the expander cylinders would be opened and the two-way valve at 141 would be closed. During reserve air operation both the blocking valve between the compressor and expander cylinders and the two-way valve at 141 would be opened. If desired, the compressor cylinder(s) could be deactivated while in the reserve air operation mode, as described earlier.

Operating the engine on reserve air supply would improve the net mean effective pressure (NMEP) of the engine for greater power and efficiency.

This feature would produce additional savings in energy especially in heavy traffic or in hilly country. For example, an engine producing 100 horsepower uses 12.7 pounds of air per minute. Therefore, if all energy of braking were stored in the compressed air in the economizer reservoir, a ten, twenty or even thirty minute supply of compressed air can be accumulated and stored during stops and down hill travel. When the reservoir pressure drops below the desired level for efficient operation, a solenoid will reactivate the compression cylinder valves and they (with the supercharger, when needed) will begin to compress the air charge needed by the engine.

Using an air reservoir, the engine would need no compression build-up for starting and as soon as the shaft was rotated far enough to open the intake valve, the compressed air and fuel would enter and be ignited for "instant" starting. Furthermore, the compressed air could be used to rotate the engine for this means of starting by opening intake valves earlier than usual to the expander cylinders to begin rotation and firing as is common in large diesel engines, thus eliminating the need for a starter motor.

An additional means to those already suggested of facilitating cranking of the engine is to hold the intake valve 'i' or the bypass valves 35, 36 and 37 of FIG. 7 open during the full downstroke of the associated piston thereafter closing the intake valves, holding the exhaust valves closed and then beginning the upstroke of the piston, adding the fuel (if not premixed) and igniting it near the completion of the upstroke, the next downstroke becoming the power stroke afterward returning to the valve timing normally used for this working cycle.

Referring again to FIG. 12, these structures could also be used to lower polluting emissions by providing for a two-stage combustion system. In this usage the intake valve 'i' would be opened before the projection 150 on piston **6*b* occludes the combustion chamber 151 and closed before the top dead center piston position. This would allow part of the air charge to enter and remain in the cylinder 2*b* in space provided above the piston crown after the combustion chamber 151 closure but separated from the remainder of the charge which enters the combustion chamber 151 (in this instance the pre-combustion chamber) after the bottom opening of the combustion chamber 151 is closed. At this point, substantially before top dead center position, the intake valve 'i' closes and part of the air charge is contained in the pre-combustion chamber 151 and part of the air charge is contained in the top of the cylinder 2*b***, the combustion chamber proper, in this instance.

The two-stage combustion system would operate in this manner:

1. Pre-Combustion (first stage)

Pre-combustion occurs at high pressure in the hot pre-combustion chamber 151 when fuel in an amount in excess of the amount of oxygen present is injected and ignited (injector not shown). This oxygen deficiency greatly reduces the formation of oxides of nitrogen. The combination of the hot pre-combustion chamber wall and intense turbulence largely prevents the creation of odoriferous substances.

2. Post-Combustion (second stage)

Post-combustion takes place at low pressure and relatively low temperature conditions in the space above the piston **6*b* in the cylinder 2*b* as the gases expand from the first stage pre-combustion chamber 151 into the cylinder proper 2*b* as the chamber 151** is uncovered. The low temperature and the admixture of burned gases prevent any further formation of oxides of nitrogen. Excess air, a strong swirling action, and the extended expansion process assure complete combustion of carbon monoxide, hydrocarbons, and carbon (soot and smoke). The results are the higher thermal efficiencies due to the greater expansion process, and a cooler exhaust with a lower level of polluting emissions. As in the other designs, the smaller charge, although fired twice as often, lessens noise pollution.

Again referring to FIG. 12, the structures of the pre-combustion chamber 151, the projection 150 on piston **6*b* and space above piston 6*b* in cylinder 2*b*** can be used in a conventional 2-stroke or 4-stroke cycle diesel engine to provide a divided combustion chamber and two-stage combustion with all of the advantages described for reducing emissions but without any additional expansion of gases.

The structures of FIG. 12 would also provide for stratified charge and lean burning charge in conventional 2-stroke or 4-stroke cycle gasoline, or gas engines.

In either the conventional compression ignited engine or the conventional spark ignited engine the operation would be the usual except that in the compression stroke of piston **6*b* in all cylinders part of the charge would be compressed into chamber 151 before closure by projection 150 and part of the charge would be compressed in the space above piston 6*b* within cylinder 2*b***. Fuel in an amount in excess of the amount of oxygen present is then injected and ignited. The two stages of combustion will then take place as described herein.

The two-stage combustion system for conventional engines would operate in this manner:

1. Pre-Combustion (first stage)

Pre-combustion occurs at high pressure in the hot pre-combustion chamber 151 when fuel in an amount in excess of the amount of oxygen present is injected and ignited (injector not shown). This oxygen deficiency greatly reduces the formation of oxides of nitrogen. The combination of the hot pre-combustion chamber wall and intense turbulence largely prevents the creation of odoriferous substances.

2. Post-Combustion (second stage)

Post-combustion takes place at low pressure and relatively low temperature conditions in the space above the piston 6b in the cylinder 2b as the gases expand from the first stage pre-combustion chamber 151 into the cylinder proper 2b as the chamber 151 is uncovered. The low temperature and the admixture of burned gases prevent any further formation of oxides of nitrogen. Excess air and a strong swirling action assure complete combustion of carbon monoxide, hydrocarbons, and carbon (soot and smoke). The results are a cooler exhaust with a lower level of polluting emissions and in the Otto cycle engine, higher thermal efficiencies due to a leaner burning charge.

In the use of this two-stage combustion system in conventional Diesel cycle or Otto cycle engines the placement and operation of intake valves and exhaust valves would be as normally done. In a spark ignited engine the sparking plug would be placed in the pre-combustion chamber 151, FIG. 12.

What I claim is:

1. A method of deriving mechanical work from combustion gas in an internal combustion engine having at least two two-stroke power chambers in which combustion gases are ignited and expanded, and a piston operable in each chamber, and a compressor in which an air charge is compressed, comprising the steps of compressing an air charge in a compressor, transferring the compressed air charge to each power cylinder at such time as the piston in the power cylinder is near top dead center with the total combustion volume of the power cylinder being no greater than the volume of the charge transferred from the compressor at the time of transfer such that there is no appreciable pressure drop during transfer, causing a predetermined quantity of fuel to be mixed with the air charge to produce a combustible mixture with combustion beginning before or at top dead center, causing the mixture to be ignited at substantially maximum pressure within each power chamber and expanding the combustion gas against the piston substantially beyond its initial volume, with combustion in each power cylinder occurring on alternate strokes of the pistons with scavenging by the piston occurring on alternate strokes by positive displacement of the burned gases.

2. A method of deriving mechanical work from combustion gas in an internal combustion engine having a two stroke power chamber in which the combustion gas is ignited and expanded, a compressor chamber in which an air charge is compressed and a piston operable in each chamber, comprising the steps of compressing an air charge in the compressor chamber, transferring the compressed air charge to the power chamber with the total combustion chamber volume of the power chamber being no greater than the volume of the charge transferred from the compressor chamber at the time of transfer such that there is no appreciable pressure drop during transfer, causing a predetermined quantity of fuel to be mixed with the air charge to produce a combustible mixture, causing the mixture to be ignited at substantially maximum pressure within the power chamber and expanding the combustion gas against the piston substantially beyond its initial volume.

3. A method according to claim 2 in which the fuel is mixed with the air charge to produce a combustible gas prior to admission into the compressor chamber.

4. A method according to claim 2 in which the fuel is mixed with the air charge to produce a combustible gas after leaving the compressor chamber but prior to admission into the power chamber.

5. A method according to claim 2 in which the fuel is mixed with the air charge to produce a combustible mixture within the power chamber.

6. A method according to claim 2 in which the power chamber is provided by a cylinder in which a piston is reciprocable, and wherein said combustible mixture is ignited during piston travel near top dead center of the cylinder.

7. A reciprocating internal combustion engine comprising a compressor chamber for compressing an air charge, a power chamber in which the combustion gas is ignited and expanded, a piston operable in each chamber and connected to a common crankshaft by connecting link means for rotating the crankshaft in response to reciprocation of each piston, a transfer duct communicating the compressor chamber with the power chamber through which duct the compressed charge is transferred to enter the power chamber, an intake valve controlling admission of air to said compressor chamber for compression, a transfer valve controlling admission of the compressed charge to said transfer duct, an intake valve controlling admission of the compressed air charge from the transfer duct to said power chamber, and an exhaust valve controlling discharge of the exhaust gases from the power chamber, said valves being timed to operate such that the air charge is maintained within the transfer duct and introduced into the power chamber without any appreciable drop in charge pressure so that ignition can commence at substantially maximum compression, means being provided for causing fuel to be mixed with the air charge to produce the combustible gas, and wherein said compressor chamber and the combustion chamber of said power chamber are sized with respect to the displaced volume of said power chamber with the total combustion chamber volume of the power chamber being no greater than the volume of the charge transferred from the compressor chamber at the time of transfer such that the exploded combustion gas can be expanded substantially beyond its initial volume when transferred to the power chamber.

8. An engine according to claim 7 in which the power chamber and the compressor chamber are provided by the two separate cylinders with a piston reciprocable in each cylinder and wherein the volume of said compressor cylinder is less than that of said power cylinder.

9. An engine according to claim 7 in which an air reservoir, a connector duct communicating the air reservoir with the transfer duct and means for controlling the flow of air between the air reservoir and transfer duct are provided, so that air can be supplied from the transfer duct to the air reservoir when desired and air can be supplied from the air reservoir to the transfer duct when needed for engine operation in order to increase the efficiency of the engine by conserving air compressed during periods when not needed for engine operation.

10. An engine according to claim 7 in which a plurality of power cylinders and at least one compressor cylinder are provided, said transfer duct comprising a common manifold for supplying a compressed air charge from each compressor cylinder to said power cylinders with the total combustion chamber volume of the power cylinders being no greater than the volume of the charge transferred from the compressor cylinder at the time of transfer, and wherein each power cylinder is timed to be charged and fired on alternate strokes of its piston and scavenged by positive displacement by the piston.

11. An engine according to claim 10 in which ports are provided intermediate the ends of each power cylinder to aid scavenging, said ports being uncovered by the piston at the completion of the power stroke towards its bottom dead center position.

12. An engine according to claim 10 in which the ports intermediate the ends of the power cylinders are provided with means for receiving compressed air to aid in the scavenging process.

13. An engine according to claim 10 in which each power cylinder is timed to fire before or at top dead center position of its piston.

14. An engine according to claim 10 in which each power cylinder is timed to fire after top dead center position of its piston.

15. An engine according to claim 10 in which valve means are provided for temporarily preventing admission of said charge to power cylinder after said charge has been admitted to the combustion chamber by the intake valve before top dead center so the power piston rises in its exhaust stroke and in which the exhaust valve can remain open past top dead center to facilitate exhaust scavenging.

16. An engine according to claim 10 in which each compressor cylinder has a double-acting piston the arrangement being such that an air charge is compressed during each stroke of the double-acting piston and admitted to said common manifold.

17. An engine according to claim 10 in which fuel metering means is provided for causing fuel to be mixed with said air charge to produce a combustible gas prior to admission in each compressor cylinder.

18. An engine according to claim 10 in which fuel metering means is provided for causing fuel to be mixed with said air charge to produce a combustible gas after leaving each compressor cylinder but prior to admission into each power cylinder.

19. An engine according to claim 10 in which fuel metering is provided for causing fuel to be mixed with said air charge to produce a combustible gas after admission to the combustion chamber.

20. An engine according to claim 10 in which means are provided for restricting admission of said air charge through the intake valves of each power cylinder in order to provide compression build-up in said common manifold during engine starting.

* * * * *

UNITED STATES PATENT AND TRADEMARK OFFICE

CERTIFICATE OF CORRECTION

PATENT NO. : 4,565,167

DATED : January 21, 1986

INVENTOR(S) : Clyde C. Bryant

It is certified that error appears in the above-identified patent and that said Letters Patent is hereby corrected as shown below:

The Title Page showing the illustrative figure should be deleted to appear as per attached page.

Column 7, line 23, following "spark ignition" insert -- or --.

Column 9, line 45, "60" should read -- 69 --.

Column 10, line 5, "abut" should read -- about --.

Column 11, line 53, "be" should read -- by --.

United States Patent [19]

Bryant

[11] Patent Number: 4,565,167

[45] Date of Patent: Jan. 21, 1986

[54] INTERNAL COMBUSTION ENGINE

[76] Inventor: Clyde C. Bryant, 1920 Forrest Ave., East Point, Ga. 30344

[21] Appl. No.: 612,660

[22] Filed: May 21, 1984

Related U.S. Application Data

[63] Continuation-in-part of Ser. No. 327,922, Dec. 8, 1981, abandoned, which is a continuation-in-part of Ser. No. 230,752, Feb. 2, 1981, abandoned.

[51] Int. Cl.[4] ..... F02B 33/22

[52] U.S. Cl. ..... 123/70 R; 123/560; 417/364

[58] Field of Search ..... 123/70 R, 70 V, 560; 417/237, 380, 364

[56] References Cited

U.S. PATENT DOCUMENTS

| | | | |
|---|---|---|---|
| 1,389,337 | 8/1921 | Wolfard | 123/70 V |
| 2,102,946 | 12/1937 | Dugelay | 123/560 |
| 2,281,821 | 5/1942 | Balmer | 123/70 R X |
| 2,500,366 | 3/1950 | Lamberton | 417/364 |
| 2,594,845 | 4/1952 | Baumann | 123/70 R |
| 2,736,488 | 2/1956 | Dros | 417/364 |
| 3,623,463 | 11/1971 | De Vries | 123/70 R |
| 3,675,630 | 7/1972 | Stratton | 123/70 R |
| 3,880,126 | 4/1975 | Thurston et al. | 123/70 R |
| 4,351,278 | 9/1982 | Gaschler et al. | 417/364 X |

*Primary Examiner*—Parshotam S. Lall
*Assistant Examiner*—W. R. Wolfe

[57] ABSTRACT

The invention is concerned with a method of deriving mechanical work from a combustion gas in an internal combustion engine and reciprocating internal combustion engines for carrying out the method. The method includes the steps of compressing an air charge in a compressor of the engine, transferring the compressed charge to a power chamber of the engine such that no appreciable drop in charge pressure occurs during transfer and admission to the power chamber, causing a predetermined quantity to produce a combustible mixture, causing the mixture to be ignited at substantially maximum pressure within the power chamber and allowing the combustion gas to expand against a piston operable in the power chamber substantially beyond its initial volume.

20 Claims, 14 Drawing Figures

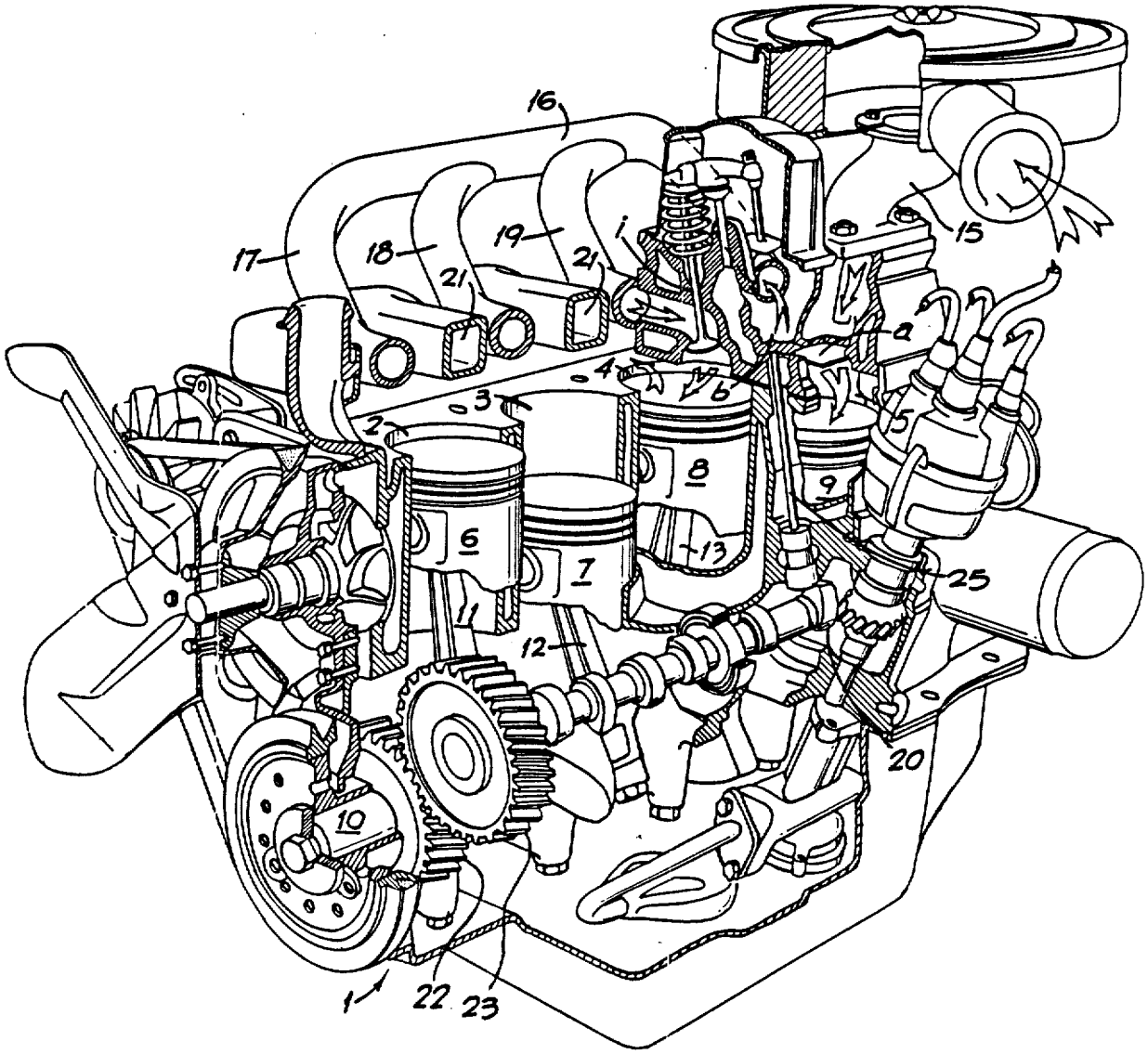

UNITED STATES PATENT AND TRADEMARK OFFICE

CERTIFICATE OF CORRECTION

PATENT NO. : 4,565,167

DATED : Jan. 21, 1986

INVENTOR(S) : Clyde C. Bryant

It is certified that error appears in the above-identified patent and that said Letters Patent is hereby corrected as shown below:

Figure 1 has been corrected by adding reference numeral 10 and broken lines and shading as shown below:

FIG 1

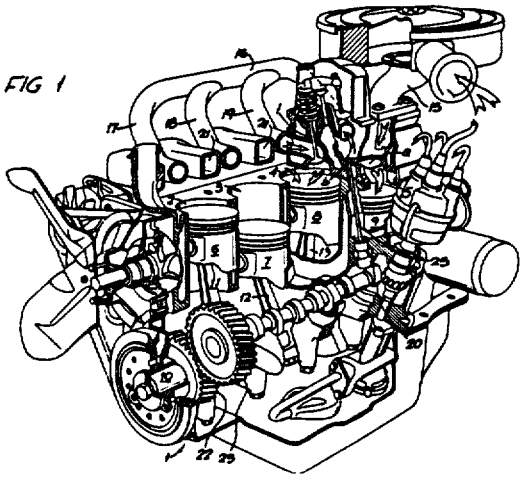

Signed and Sealed this

Thirteenth Day of October, 1987

*Attest:*

DONALD J. QUIGG

*Attesting Officer*

*Commissioner of Patents and Trademarks*